United States Patent [19]

Epsom et al.

[11] Patent Number: 4,475,092

[45] Date of Patent: Oct. 2, 1984

[54] ABSORPTIVE RESONANT CAVITY FILTER

[75] Inventors: Robert L. Epsom, Hanover Park; Richard S. Kommrusch, Schaumburg, both of Ill.

[73] Assignee: Motorola Inc., Schaumburg, Ill.

[21] Appl. No.: 451,504

[22] Filed: Dec. 20, 1982

[51] Int. Cl.[3] ..... H01P 1/202; H01P 7/04; H01P 5/02; H01P 1/26

[52] U.S. Cl. ..... 333/206; 333/22 R; 333/33; 333/202; 333/230

[58] Field of Search ..... 333/167–171, 333/174–176, 202–212, 219–235, 238, 245, 248, 24.2, 22 R, 22 F, 32–35

[56] References Cited

U.S. PATENT DOCUMENTS

| | | | |
|---|---|---|---|
| 2,946,027 | 7/1960 | Gerard et al. | 333/229 |
| 3,067,394 | 12/1962 | Zimmerman et al. | 333/235 X |
| 3,424,983 | 1/1969 | Schilb . | |
| 3,478,188 | 11/1969 | White | 333/227 |
| 3,504,303 | 3/1970 | Konishi | 333/229 X |
| 3,537,041 | 10/1970 | Kommrusch | 333/202 |
| 3,600,711 | 8/1971 | Gerlack | 333/206 |
| 3,714,608 | 1/1973 | Barnes et al. | 333/248 |
| 3,876,963 | 4/1975 | Graham | 333/227 X |
| 3,911,382 | 10/1975 | Harth et al. | 333/238 X |
| 3,939,443 | 2/1976 | Biró et al. | 333/202 |

*Primary Examiner*—Marvin L. Nussbaum

*Attorney, Agent, or Firm*—F. John Motsinger; Edward M. Roney; James W. Gillman

[57] ABSTRACT

An absorptive resonant cavity filter suitable for use on the output of a transmitter power amplifier and capable of substantially constant predetermined resistive input impedance at all frequencies. The structure comprises a bandpass cavity which instead of an input coupling loop employs a conductor coupled from the input and configured along the wall of the cavity to form a transmission line of predetermined impedance and terminated by a resistor of similar impedance value.

7 Claims, 1 Drawing Figure

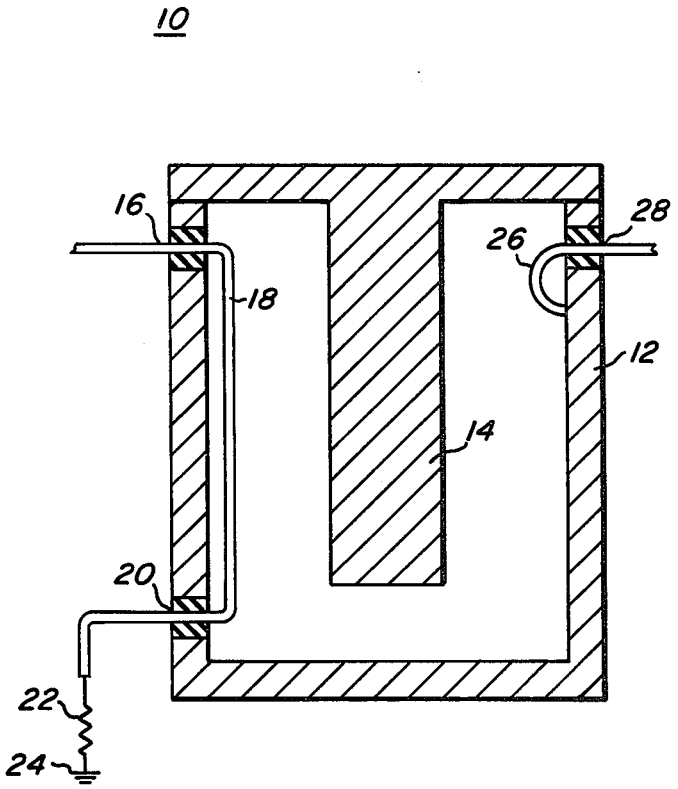
10
16
28
26
18
12
14
20
22
24

ABSORPTIVE RESONANT CAVITY FILTER

BACKGROUND OF THE INVENTION

1. Field of the Invention

This invention relates to the field of resonant cavity filters and more particularly to an absorptive resonant cavity with substantially constant resistive input impedance of a predetermined resistive value at all off resonant frequencies.

2. Description of the Prior Art

In communications systems, it is often desirable to provide filtering for the receivers and transmitters so that intermodulation and splatter can be reduced. Cavity resonators have been affectively used in such systems are filters since they are very high Q circuits which can be easily inserted in a line connecting a transmitter amplifier or a receiver amplifier with an antenna.

However, cavity resonators in the prior art do not have a uniform resistive input impedance for frequencies outside the bandpass of the filter. This causes instability for power amplifiers coupled to the resonator which can destroy the amplifier and which complicate amplifier design. The typical prior art solution to this problem for transmitter circuits is to insert a circulator, which is both expensive and bulky, between the power amplifier and the cavity resonator. The addition of the circulator also results in undesired signal losses and greater circuit complexity.

SUMMARY OF THE INVENTION

Accordingly, it is an object of this invention to provide a resonant cavity filter with a substantially constant input impedance of predetermined resistive value for all off resonant frequencies.

It is another object of this invention to provide a resonant cavity filter suitable for use with a transmitter which simplifies amplifier design and reduces instability without compromising bandpass properties.

Briefly, according to the invention, an absorptive resonant cavity filter is provided which is composed of a resonant cavity forming an enclosure made of conductive material and including an input port for coupling RF energy into the resonant cavity. In addition, a first output port is provided for terminating off resonant RF energy into a predetermined resistive load, and a conductor is used to couple the input port to the first output port. A second output port couples the resonant RF energy to an output load.

BRIEF DESCRIPTION OF THE DRAWING

The features of the present invention which are believed to be novel are set forth with particularity in the appended claims. The invention itself together with further objects, features, and advantages thereof, may best be understood by reference to the following description when taken in conjunction with the accompanying drawing.

DETAILED DESCRIPTION OF THE PREFERRED EMBODIMENT

Referring to the FIGURE, there is shown a cross-section of an absorptive resonant cavity filter 10, according to the invention. The cavity 10 is constructed of conductive material to form an enclosure 12, including in the preferred embodiment a resonant structure 14, also of conductive material. It is widely known in the art that the cavity can be constructed to be resonant at any of a wide range of RF frequencies, depending upon the physical dimensions chosen. It should be noted also, that the resonant structure 14, can be reduced to zero length at one extreme, or at the other extreme to a coiled length of conductor connected at one end to the cavity enclosure (i.e., helical resonator). An input port 16 is provided, as shown, to permit RF energy to be coupled into the cavity. A conductor 18, is coupled at one end to the input port 16, and at the other end to an output port 20, as shown. This conductor 18 is configured to form a transmission line of predetermined impedance in conjunction with the cavity wall. A resistor 22 is provided to couple the output port 20 to the ground 24. An output coupling loop 26 is provided, to couple resonant RF energy from the cavity to the output port 28, as shown.

In the preferred mode of operation, RF signals from a transmitter power amplifier (not shown), having an output impedance of 50 ohms, are coupled to the input port 16. Also, in the preferred embodiment, the conductor 18 is fixed in proximity to the cavity so as to form a 50 ohm transmission line, which is terminated by the resistor 22, which is also 50 ohms. (Preferrably, the resistor 22 should be nearly equal to the transmission line impedance. It is also preferrable that the conductor 18 have an electrical length of approximately a quarter wavelength at the resonent frequency). As a result, substantially all the RF signals applied from the transmitter which are outside the resonant passband will be coupled down the 50 ohm transmission and are dissipated in the 50 ohm load resistor without being reflected back into the power amplifier. In other words, at these frequencies the input impedance of the resonant cavity is approximately 50 ohms resistive and very little of this RF energy is coupled to the output port 28. It should also be noted that with appropriate configuration of the conductor 18 and choice of the resistor 22, virtually any input impedance can be established. However, RF energy at a frequency equal to the resonant frequency of the cavity is coupled to the resonant structure 14 and, with minor insertion losses, to the output port 28. In the preferrred application, this signal is then coupled to an antenna (not shown) of 50 ohm impedance. Thus, the input impedance of the cavity at the input port 16 is again 50 ohms resistive with none of the resonant RF energy being dissipated in the resistor 22. For frequencies near the resonant frequency, only part of the RF energy will be coupled down the transmission line 18 to be dissipated in the resistor 22, while the rest will be coupled to the resonant structure 14 and then to the output port 28. The result of this combined affect will again be an input impedance at the input port 16 of approximately 50 ohms resistive. Thus, in this application, the invention provides a resonant cavity filter with an input impedance of approximately 50 ohms resistive at all frequencies. It has also been found that this result remains substantially the same regardless of the length of transmission line leading to the input port 16.

From the foregoing description, it can be seen that a novel absorptive resonant cavity, suitable for use with a transmitter amplifier, has been provided which maintains a predetermined resistive input impedance at all frequencies without substantially degrading the cavity performance.

While a preferred embodiment of the invention has been described and shown, it should be understood that other variations and modifications may be implemented.

It is therefore contemplated to cover by the present application any and all modifications and variations that fall within the true spirit and scope of the basic underlying principles disclosed herein.

What is claimed is:

1. An absorptive resonant cavity filter having a characteristic resonant frequency comprising:

resonant cavity means, forming an enclosure composed of conductive material;

input means, for coupling RF energy into the resonant cavity;

first output means, for terminating off resonant RF energy into a predetermined resistive load;

conductor means, for coupling the input means to the first output means;

second output means for coupling resonant RF energy to an output load.

2. The absorptive resonant filter of claim 1 wherein the first output means terminates off resonant RF energy into a resistive load of approximately 50 ohms.

3. The absorptive resonant filter of claim 2, wherein the conductor means forms approximately 50 ohm transmission line in conjunction with the conductive enclosure.

4. The absorptive resonant filter of claim 1 wherein the resonant cavity further comprises a resonant structure composed of a length of conductive material coupled to the resonant cavity enclosure and extending into the enclosed cavity.

5. The absorptive resonant filter of claim 1 wherein the conductor means further comprises a conductor rigidly mounted within the resonant cavity with predetermined spacing from the enclosure material.

6. The absorptive resonant filter of claim 3 wherein the resonant cavity further comprises a resonant structure composed of a length of conductive material coupled to the resonant cavity enclosure and extending into the enclosed cavity.

7. The absorptive resonant filter of claim 5 wherein the conductor means has an electrical length of a quarter wavelength at the characteristic resonant frequency.

* * * * *